United States Patent [19]

McDuffee

[11] 4,277,853

[45] Jul. 14, 1981

[54] FOR TOILET BOWL CLEANING

[75] Inventor: Richard L. McDuffee, Aurora, Ill.

[73] Assignee: Twinoak Products, Inc., Plano, Ill.

[21] Appl. No.: 181,906

[22] Filed: Aug. 27, 1980

Related U.S. Application Data

[63] Continuation of Ser. No. 964,276, Nov. 28, 1978, abandoned.

[51] Int. Cl.[3] ..... E03D 9/02; B65D 51/24

[52] U.S. Cl. ..... 4/228; 215/302; 215/303; 422/277

[58] Field of Search ..... 4/222, 225, 227, 228, 4/294, 222.1, 301, 453; 285/35, 39; 81/90 C; 215/6, 10, 295, 302, 303; 210/282; 422/277, 220, 230, 261

[56] References Cited

U.S. PATENT DOCUMENTS

| | | | |
|---|---|---|---|
| 565,758 | 8/1896 | Kurten | 4/225 |
| 685,020 | 10/1901 | Venners | 4/228 |
| 1,803,860 | 5/1931 | Marks | 4/228 |
| 2,076,549 | 4/1937 | Conner | 215/6 |
| 2,332,030 | 10/1943 | Toronto | 422/277 |
| 2,807,807 | 10/1957 | Harper | 4/228 |
| 2,934,409 | 4/1960 | Biehl | 4/222 X |
| 3,204,770 | 9/1965 | Brink | 210/282 |
| 3,521,306 | 7/1970 | Jacobs | 4/228 |
| 3,545,011 | 12/1970 | Davis | 4/228 |
| 3,604,020 | 7/1971 | Moisa | 4/228 |
| 3,781,926 | 1/1974 | Levey | 4/228 |
| 3,799,352 | 3/1974 | McClive | 210/282 |
| 3,809,271 | 5/1974 | Stroud | 215/302 X |
| 3,837,017 | 9/1974 | McDuffee | 4/228 |

*Primary Examiner*—Stuart S. Levy

*Attorney, Agent, or Firm*—McDougall, Hersh & Scott

[57] ABSTRACT

A toilet bowl cleaning means wherein a container is located within a water tank associated with the bowl with a cleaning compound such as calcium hypochlorite included within the container. A plurality of openings are provided, and this provides exposure to water in the tank so that the compound will be dissolved in the water and thereby delivered to the bowl when the toilet is flushed. The openings may be formed in a centrally located cylinder with the compound located within the cylinder and with a water space between the cylinder and the outer container walls. Controlled amounts of compound are thereby released to the water in this area.

8 Claims, 12 Drawing Figures

FIG. 1
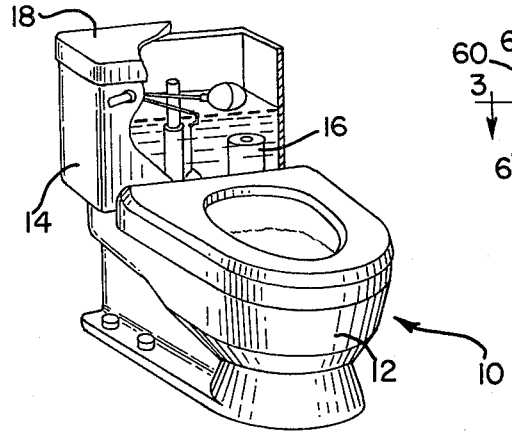
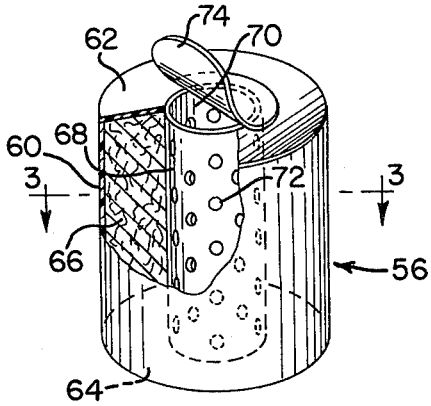
FIG. 5
FIG. 6
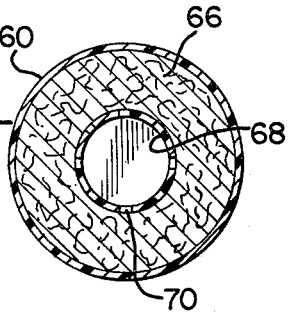
FIG. 8
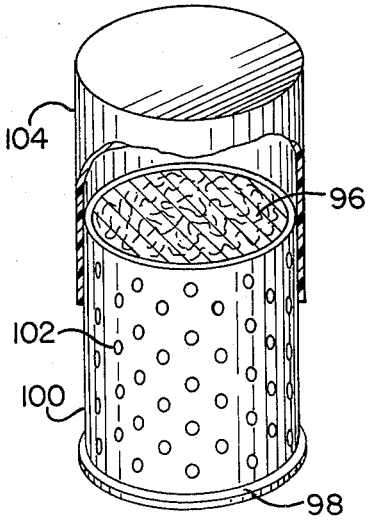
FIG. 7
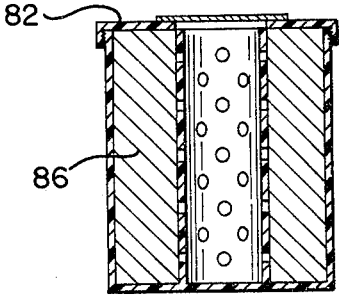

FOR TOILET BOWL CLEANING

This is a continuation of application Ser. No. 964,276, filed Nov. 28, 1978 now abandoned.

BACKGROUND OF THE INVENTION

The invention relates to improvements in the known technique of locating a toilet bowl cleaner compound in a water tank associated with the bowl whereby the compound will be carried into the bowl along with the water from the tank during flushing of the toilet.

It is known that various problems are encountered with prior art systems. Basically, it has not been possible to adequately control the use of a cleaning compound whereby automatic bowl cleaning can be accomplished on an efficient basis. Some systems are characterized by too great an exposure of the compound to water whereby the compound dissipates at an undesirably fast rate. Where devices are provided for controlling the rate of dispersal of the compound on an efficient basis, the expense of such devices tends to be prohibitive, and timing the life of the bowl cleaner compound can be quite difficult.

Harper U.S. Pat. No. 2,807,807; Jacobs U.S. Pat. No. 3,521,306; Davis U.S. Pat. No. 3,545,014; and Moisa U.S. Pat. No. 3,604,020 provide examples of prior art teachings of the type referred to. Applicant's U.S. Pat. No. 3,837,017 discloses an improved system whereby the compound is confined in containers along with stone or the like. This combination along with the container design provides for distinctly improved efficiency.

SUMMARY OF THE INVENTION

Generally, this invention provides further improvements in toilet bowl cleaning whereby the bowls can be cleaned and otherwise sanitized.

The invention particularly provides a system for automatic toilet bowl cleaning which involves the use of structures which are more efficiently produced, which require very simple operating steps whereby the arrangement of the invention can be employed without great difficulty, and which operate to vary the life of the bowl cleaner for desired durations.

The structure of the invention in its preferred forms includes a container having closed bottom and side walls for confining the cleaning compound. At the top there is provided either an annular or central opening through which water can enter into an annular or cylindrical inner chamber. The inner chamber walls are perforated or otherwise provided with a plurality of openings. Each opening serves to expose the compound which is confined adjacent the chamber wall. This arrangement maintains the water within the container in a quiet state which minimizes loss of compound particularly when the toilet is not in use. Controlled release occurs when the toilet is flushed but there is no acceleration of the loss of compound due to the combination of openings and the position of the openings in the chamber wall.

BRIEF DESCRIPTION OF THE DRAWINGS

FIG. 1 is a perspective view of a toilet bowl and associated water tank having the structure of this invention associated therewith;

FIG. 5 is a perspective view of one alternative form of a container which may be employed in the system of the invention;

FIG. 6 is a cross-sectional view of the container taken about the line 5—5 of FIG. 5;

FIG. 7 is a vertical sectional view of another Alternative form;

FIG. 8 is a perspective view of a still further alternative form of a container;

DETAILED DESCRIPTION OF THE DRAWINGS

Figure 2:
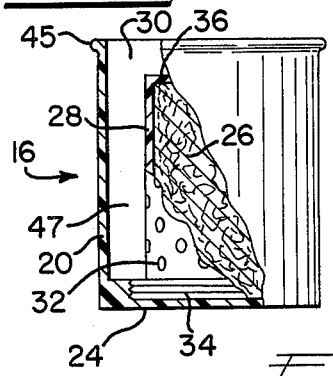
FIG. 2 is an elevational view, partly cut away, illustrating a preferred form of the invention.

In the drawings, FIG. 1 illustrates a toilet 10 comprising bowl 12 and water tank 14. A container 16 is located in the water tank below the water level. This container holds a chemical compound of the type conventionally utilized for cleaning the toilet bowl. Calcium hypochlorite comprises an example of a suitable chemical employed for this purpose. In the ordinary case, the cover 18 for the tank 14 is removable so that the container 16 can be located in position, and so that a replacement container can be provided when necessary.

Figure 3:
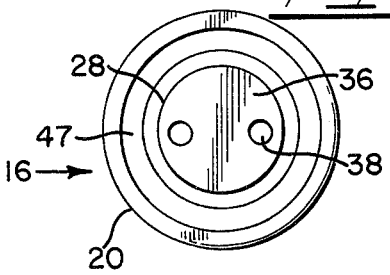
FIG. 3 is a top view of the structure shown in FIG. 2.

FIGS. 2 and 3 illustrate the structure of a container 16 which constitutes a preferred form of the invention. This comprises an outer wall 20 and bottom wall 24. The compound 26 located within the container may take various forms, for example the compound may be pelletized into cylindrical form whereby it will exhibit the self-sustaining shape shown in the drawings. It is contemplated, however, that the compound could be located in the container in a granular state, and this invention does not require the utilization of intermixed inert material for purposes of inhibiting the rate of use of the compound.

The container 16 includes an inner cylindrical portion 28 which is exposed through opening 30 defined at the top wall of the container. A plurality of perforations 32 are formed in the inner cylinder 28.

The bottom edge of inner cylindrical portion 28 is threaded as shown at 34. The bottom wall 24 of container 16 defines an internally threaded seat whereby the cylindrical portion 28 can be removably secured in place.

Figure 4:
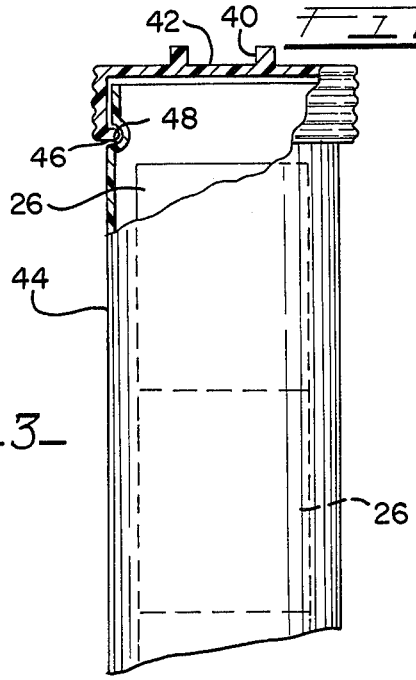
FIG. 4 is an elevational view, partly cut away, illustrating a canister for replacement briquets or the like utilized as a part of the combination of the invention.

As best shown in FIG. 3, the inner cylindrical portion 28 defines a top wall 36 which in turn defines a pair of spaced apart openings 38. The openings 38 are adapted to receive studs 40 which are formed by cap 42 illustrated in FIG. 4. The cap 42 is associated with a canister 44 holding a plurality of briquets 26 made available for replacement purposes. It will be noted that a bead 46 is defined by the cap with an annular depression 48 being formed in the canister 44. Thus, the cap 42 is removably held by the canister.

As will be particularly apparent in view of the following description, the compound 26 of the inner cylindrical portion 28 will be gradually depleted of its effectiveness. When that occurs, the cap 42 is removed from canister 44 and located in position relative to the cylindrical portion 28. Specifically, the studs 40 are inserted in openings 38 whereby the cap 42 serves as a tool which is rotated for removing the inner cylindrical portion 28. The inner cylindrical portion is then cleaned to the extent necessary, and a new briquet 26 is inserted. The assembly is then replaced in position relative to the outer cylindrical 12.

The combination of the respective cylinder designs and the canister design provides a significant safety feature. Specifically, the combination prevents easy removal of the inner cylindrical portion so that access to the chemical compound is limited. Similarly, the replacement briquets are not readily accessible, and by providing openings 38 and studs 40, the replacement operation requires the particular combination of parts for replacement.

A plastic cap of conventional design is normally attached to the container 16 by means of bead 45 for covering the opening 30. When the container is ready for use, the cap is removed, and this results in the entry of water into the annular space 47 defined between cylinder 28 and wall 20. The water is exposed to the compound 26 through the openings 32 and, since the cleaning compound is soluble in water, amounts of the compound will necessarily dissolve in the water.

The bottom wall 24 is solid and, accordingly, the water will enter the container only through the opening 30. Accordingly, the water tends to remain in a relatively quiet state since it will not move rapidly in and out of the space 47 even during flushing of the toilet. In this fashion, the compound gradually enters the water which circulates through the toilet bowl when the toilet is flushed.

The rate of use of the compound is also controlled by the number and size of perforations in the inner cylinder. It is contemplated that the perforations have a diameter of from 1.5 to 19 mm and preferably from 6 to 10 mm. A typical container will range from about 3.5 to 10 cm in height and diameter with the inner cylinder height and diameter ranging from about 2 to 8.5 cm. A preferred size container will have a height and diameter of about 6 cm and an inner cylinder with a height and diameter of about 5 cm. In a container of these dimensions, the inner cylinder will have about 20 to 50 perforations.

Although dimensions have been given, it will be appreciated that variations are possible, for example in the shape of perforations used. Such variations are also contemplated relative to the other embodiments disclosed herein.

It is also to be appreciated that the concepts of this invention permit the use of a smaller container size. Thus, by eliminating stone or similar inert material, the instant invention can provide an efficient operation while providing savings in shipping and manufacturing costs.

FIGS. 5 and 6 illustrate a container 56 comprising an outer wall 60, top wall 62, and bottom wall 64. The compound 66 is located within the container, and an inner cylindrical portion 68 is exposed through opening 70 defined in the top wall 62. A plurality of perforations 72 are formed in the inner cylinder.

A plastic or paper strip 74 is normally adhered to the top wall for covering the opening 70. When the container is ready for use, the strip 74 is removed, and this results in the entry of water into the inner cylinder 68. The water is exposed to the compound 66 through the openings 72. The bottom wall 64 is solid and, accordingly, the water will enter the inner cylinder 68 only through the opening 70. Accordingly, the water, in this embodiment, also tends to remain in a relatively quiet state.

FIG. 7 illustrates a variation wherein the top wall 82 comprises a threadably removable cap. This combination is particularly desirable where the compound 86 is pelletized and where the container is to be reused. Thus, annular pieces of the compound can be replaced in the cylinder periodically whereby the expense of utilizing the system can be minimized.

FIG. 8 illustrates another alternative form of the invention wherein the compound 96 is located within a container comprising a bottom wall 98 and side wall 100. Perforations 102 extend through the side wall to provide access to the compound.

A removable outer wall 104 normally fits around the container, and this outer wall is then completely or partially removed when the structure is ready for use. It will be appreciated that by providing for partial removal, the number of openings through which the compound is exposed can be controlled. This provides a basis for controlling the rate of compound used in accordance with the particular application involved. It will be appreciated that similar masking for portions of the perforations in the other embodiments of the invention can be readily obtained.

Figure 9:
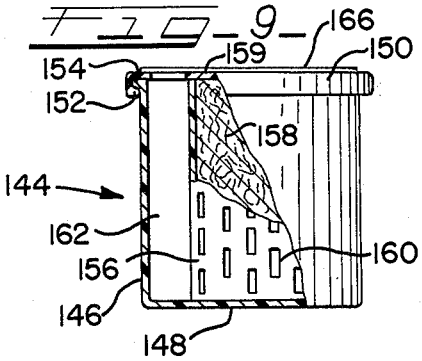
FIG. 9 is an elevational view, partly cut away, illustrating a further alternative form of the invention.
Figure 10:
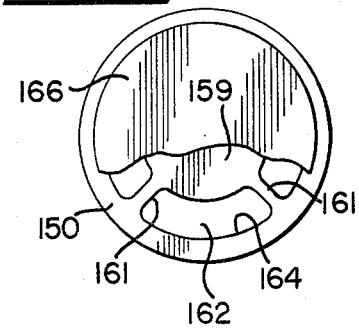
FIG. 10 is a top view of the structure of FIG. 9, partly cut away.

In accordance with the arrangement of the invention shown in FIGS. 9 and 10, a container 144 is provided with side wall 146 and bottom wall 148. A cap 150 includes an inwardly extending bead 152 while the wall 146 includes an outwardly extending bead 154. This provides for secure holding of the cap while also permitting ready removal of the cap.

An inner cylinder wall 156 is provided for holding compound 158 with the central section 159 of cap 150 serving as a closure means. Ribs 161 connect this central portion with the cap rim. The water will be located in annular chamber 162 which is exposed through an annular opening 164 in the cap 150. Rectangular slots 160 are provided for exposing the compound to the water through the cylinder wall, this embodiment thereby illustrating one possible variation of the configuration of such openings.

A pressure sensitive strip 166 or other suitable removable piece may be employed for closing the annular opening 164 until the container is ready for use. It will be appreciated that with this arrangement, the compound can also be replenished when depleted whereby the container can be reused. It will also be understood, however, that with any form of the invention, relatively inexpensive containers can be produced whereby a completely new container and contents can be used each time the supply of compound has been depleted.

Figure 11:
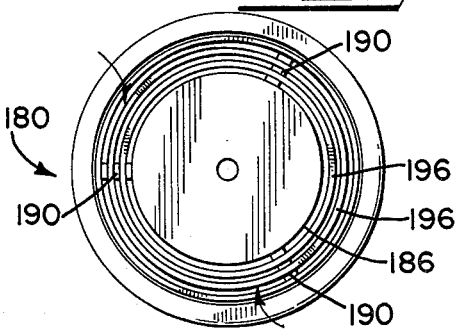
FIG. 11 is a top view of a further alternative form of the invention.
Figure 12:
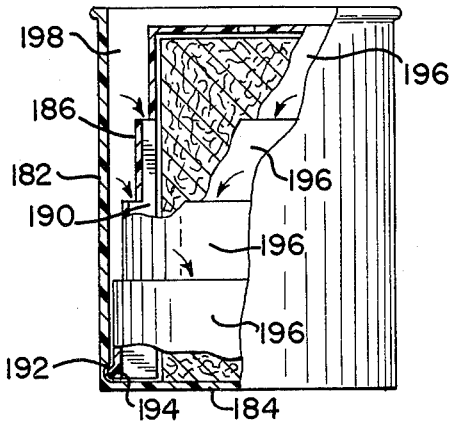
FIG. 12 is an elevational view, partly cut away, further illustrating the structure of FIG. 11.

In FIGS. 11 and 12, the container 180 comprises side wall 182 and closed bottom wall 184. An inner holder 186 defines an open top covered by cap 191. This holder serves to support the compound 188 which is in the form of a cylindrical briquet or pelletized member. This compound engages the three posts 190 which hold the compound centered relative to the holder 186.

The bottom of holder 186 defines a bead 192 which is received in depression 194 defined by the container 180 whereby the holder can be secured in position. This arrangement permits removal and reuse of the holder after insertion of new compound.

The posts 190 support cylindrical wall sections 196, and these sections are of increasing diameter and therefore slightly spaced to permit water access from annular chamber 198. These sections 196 extend between the respective posts whereby water access is achieved in the areas between the posts as shown by the arrows in the drawings.

It will be understood that various changes and modifications may be made in the above described system without departing from the spirit of the invention particularly as defined in the following claims.

That which is claimed is:

1. In a container for a system for cleaning toilet bowls wherein the container is located within a water tank associated with the bowl, and wherein a cleaning compound located within the container is exposed to the water present in the tank for entry of the compound into the water whereby water containing the compound is delivered to the toilet bowl when the toilet is flushed, the improvement wherein said container comprises an outer wall, a closed bottom wall, an inner wall in contact with said closed bottom wall and a top wall, a first holding space defined between said outer wall and said inner wall and a second holding space defined within said inner wall, a plurality of perforations defined by said inner wall, said top wall defining an opening providing access of water to said perforations, said perforations being exposed to the water when the container is located in said tank, said compound filling one of said holding spaces provided in the container whereby the compound is located directly adjacent a surface of said inner wall for contact of the compound by water in the area of said perforations, said outer wall and said inner wall comprise coaxially disposed cylinders, wherein the holding space containing the compound has a closed top wall portion and the other said holding space defines a water chamber having an open top wall portion for communicating with said water chamber and said perforations, and means otherwise preventing access of the water to the container whereby the entry of compound into the water is controlled by said perforations.

2. A construction in accordance with claim 1 wherein said compound is confined within the second holding space defined by said inner wall.

3. A construction in accordance with claim 1 wherein said compound is pelletized, said pelletized compound comprising a one-piece structure and being dimensioned to substantially fill the one holding space provided in the container for holding the compound.

4. A construction in accordance with claim 3 including a canister for holding a plurality of pellets of said compound, said pellets being adapted to be located within said container as replacements for depleted pellets.

5. A construction in accordance with claim 4 wherein said inner wall is detachably connected to said outer wall and being removable for replacement of pellets.

6. A construction in accordance with claim 5 wherein said outer wall and said inner wall are threadably attached.

7. A construction in accordance with claim 6 including a cover for said canister, engaging means defined by said cover, said engaging means providing a tool for engagement with said inner wall for unthreading said inner wall relative to said outer wall.

8. A construction in accordance with claim 1 wherein the closed top wall on said holding space containing the compound is removable whereby said compound can be replenished.

* * * * *